US007053014B2

(12) United States Patent
Dewaegheneire

(10) Patent No.: US 7,053,014 B2
(45) Date of Patent: May 30, 2006

(54) BURNER MEMBRANE COMPRISING MACHINED METAL FIBER BUNDLES

(75) Inventor: Gabriël Dewaegheneire, Heule (BE)

(73) Assignees: N.V. Bekaert S.A., Zwevegem (BE); Bekaert Combustion Technology NV, Zweregem (BE)

( * ) Notice: Subject to any disclaimer, the term of this patent is extended or adjusted under 35 U.S.C. 154(b) by 217 days.

(21) Appl. No.: 10/476,876

(22) PCT Filed: May 7, 2002

(86) PCT No.: PCT/EP02/05062

§ 371 (c)(1),
(2), (4) Date: Nov. 13, 2003

(87) PCT Pub. No.: WO02/099173

PCT Pub. Date: Dec. 12, 2002

(65) Prior Publication Data

US 2004/0147193 A1 Jul. 29, 2004

(30) Foreign Application Priority Data

Jun. 1, 2001 (EP) ..... 01202084

(51) Int. Cl.

| | |
|---|---|
| ***B32B 15/14*** | (2006.01) |
| ***D04H 1/00*** | (2006.01) |
| ***D04B 1/16*** | (2006.01) |
| ***D03D 25/00*** | (2006.01) |

(52) U.S. Cl. ..... 442/229; 442/377; 442/376; 442/414; 442/316; 442/301; 428/220; 431/326; 431/329

(58) Field of Classification Search ..... 442/229, 442/377, 376, 414, 316, 301, 304; 428/220; 431/326–329

See application file for complete search history.

(56) References Cited

U.S. PATENT DOCUMENTS

| | | | | |
|---|---|---|---|---|
| 4,313,998 | A * | 2/1982 | Pivot et al. | 428/222 |
| 4,657,506 | A | 4/1987 | Ihlenfield et al. | |
| 4,930,199 | A | 6/1990 | Yanagisawa | |
| 6,025,282 | A * | 2/2000 | Dewaegheneire et al. | 442/6 |
| 6,063,332 | A * | 5/2000 | Imamura et al. | 419/4 |
| 6,065,963 | A * | 5/2000 | Dewaegheneire et al. | 431/329 |
| 2003/0134247 | A1* | 7/2003 | Dewaegheneire | 431/326 |
| 2003/0138629 | A1* | 7/2003 | Dewaegheneire | 428/396 |

FOREIGN PATENT DOCUMENTS

| | | | |
|---|---|---|---|
| EP | 0 897 085 | A1 | 2/1999 |
| EP | 0 982 541 | B1 | 1/2003 |
| WO | WO 97/04152 | * | 2/1997 |
| WO | WO 97/04152 | A1 | 2/1997 |
| WO | WO 99/18393 | A1 | 4/1999 |

* cited by examiner

*Primary Examiner*—Terrel Morris
*Assistant Examiner*—Matthew Matzek
(74) *Attorney, Agent, or Firm*—Foley & Lardner LLP

(57) ABSTRACT

A burner membrane comprising a textile fabric. The textile fabric comprising at least 60% by weight of machined metal fiber bundles, having a bundle voluminousity in the range of 1 to 15% and a torsion rate in the range of 10 to 80 turns/m.

16 Claims, 1 Drawing Sheet

BURNER MEMBRANE COMPRISING MACHINED METAL FIBER BUNDLES

FIELD OF THE INVENTION

The invention relates to burner membranes and textile fabrics, to be used as burner membranes.

BACKGROUND OF THE INVENTION

Burner membranes comprising metal fibers are known in the art. Metal filaments or wires are braided, woven or knitted into a textile fabric. WO97/04152 provides a method to produce a textile fabric comprising machined metal fibers, and describes the use of such fabric, preferably a knitted fabric as a burner membrane.

SUMMARY OF THE INVENTION

The present invention relates to an improvement of the presently known burner membrane comprising a textile fabric comprising machined metal fibers. Improvements relating to the covering ratio of the textile fabric, the air permeability, the uniformity of the air permeability, the density of the fabric, the lifetime of the fabric when used as burner membrane and the production cost of the fabric.

According to the present invention, a burner membrane comprising a textile fabric is provided. At least 60% of weight of the textile fabric are bundles of machined metal fibers, having a bundle voluminousity in the range of 1% to 15% and a torsion rate in the range of 10 to 80 turns per meter.

When these characteristics are varied in the mentioned ranges, it was found that a textile fabric is obtained, which provides improvements to the known metal fiber burner membrane.

The textile fabric can be woven, braided or knitted, either warp a weft knitted. Preferably however, woven textile fabrics are used.

Due to the use of bundles of machined metal fibers having at torsion rate in the mentioned range, the fabric obtains a fabric voluminousity in the range of 1% to 15%, meanwhile providing sufficient air permeability and this air permeability is sufficiently equal over the surface to provide uniform combustion of fuel over the surface of the burner membrane, comprising the textile fabric. The burner membrane comprising such woven textile fabric has significantly better results, such as equal combustion, equal radiation and radiation efficiency, when used as a radiant heating burner membrane.

Preferably the bundles of machined metal fibers have a linear weight of at least 500 tex. A linear weight higher than 10000 tex is to be avoided. In this way, the surface voluminousity of the textile fabric is kept in an acceptable range, and the thickness of the fabric does not become too large, meanwhile providing acceptable air permeability.

The covering ratio of the textile fabric is important when used as a burner membrane, in order to promote an equal and over all distribution of the fuel to be burned, independent of the firing load applied.

Firing load is to be understood the volume of combustible fuel ($m^3$) combusted per surface unit of the burner membrane.

With covering ratio of a textile fabric is meant the surface covered by the yarns, filaments or wires compared to the total surface of the textile fabric, provided by these yarns, filaments or wires, when this textile fabric is in an essentially flat position. For the purpose of the present invention, the covering ratio was measured using a measuring method, specially developed for the kind of raw material used. Measuring covering ratios of textile products comprising machined metal fibers cannot be done using the dimensions of the bundles, since too much fibers are extending outwards of the bundle, as compared to regular textile fiber bundles. A well-defined textile fabric surface (7.5 by 4.5 cm) in a flat position is put on a transparent plate, and exposed to a lighting source, applying light underneath the fabric. A digital image of 640 by 640 pixels is taken from this well-defined surface using a color camera. The digital image is captured and transformed, using standard algorithms to an HSV-image. A binary threshold is applied using 0.5 as limit. All pixels having a V-value under 0.5 are set to 0, all others are set to 1. The V-value=1 pixels are believed as pixels relating to a zone where the textile fabric does not cover the underlying luminous surface, whereas for the other pixels, these relate to zones where the textile fabric covers the underlying luminous surface. The percent of V-value=0 pixels to the total number of pixels is defined as the covering ratio of the textile fabric. It was found that textile fabrics as subject of the invention have a covering ratio of more than 70, preferably even more than 80%.

When the covering ratio is too small, the textile fabric has "open zones" or "gaps" between two warps and two wefts, which may become too large. The combustible fuel finds a preferred path via these open zones in order to flow from the upstream side to the downstream side of the burner membrane. When the open zones are too large, significantly larger flames may be found here. When the covering ratio is too high, the textile fabric becomes usually too dense, having not enough air permeability left to let passing equally the fuel in the whole firing rate range required. A burner membrane comprising a textile fabric according to the present invention, the covering ratio is sufficiently high to avoid gaps, but the elevated covering ratio does not provide such restricted air permeability. In case of a woven structure, there are always zones between two warps and/or wefts, where no bundle of machined metal fibers is present. Similar open zones may be found between adjacent and/or crossing yarns in a braided textile structure. Also in case of a knitted textile structure, either warp or weft knitted, open zones are defined by the loops and stitches of the textile fabric. Taking into account the torsion rate of the bundles of machined metal fibers and the fabric volumnousity and surface weight, it was noticed that these open zones are filled or bridged with metal fibers, extending at one end out of the bundle, but being incorporated into the bundle at its other end. As a result, the textile fabric is rather voluminous but still provides a very significant covering ratio. Fuel which passes through the burner membrane comprising such textile fabric, is always hindered by fibers, extending out of a bundle (due to the torsion factor which is not too elevated). However, these fibers are firmly integrated in the bundle due to the torsion. When a torsion factor higher as according to the present invention is used, there are not enough fibers extending the bundle to cover the "gaps" or open zones. When no or too few torsion is used, the fibers more easily migrate out of the bundle, which may cause a too quick fabric failure.

A textile fabric as subject of the invention, has a thickness in the range of 1 to 5 mm and a surface weight in the range of 0.2 to 4 $kg/m^2$. Both are mainly determined by the linear weight and bundle voluminousity of the bundles of machined metal fibers. The relatively thick but not-dense structure of the textile fabric, provides a proper insulation of the upstream side of the burner membrane as compared to the downstream side of it. When the upstream side becomes too hot, there is a risk on so-called "flash backs", where the fuel combusts at the upstream side of the burner membrane. This especially occurs when the burner membrane is fired in the "red mode", where radiant heating is provided by an downstream surface of the burner membrane, which is heated to temperatures above 1000° C. or even more than 1100° C. Due to its voluminousity, the heat at the downstream surface does not penetrate too quickly and easily downwards to the upstream surface. There is enough (relatively cold) fuel which passes through the whole depth and equally over the whole surface, to cool the burner membrane. However, since the machined metal fibers have a torsion in the bundles, all fibers which occur at the hot of stream surface, will occur also at the cold instream surface due to its spiral path in the bundle. This in contrast with machined metal fiber bundles having no torsion, where the fibers at the downstream surface are clearly distinguished from the fibers at the upstream surface. Due to the torsion, thermal energy of the fiber at the ofstream side may be conducted to the colder upstream surface, causing more efficient cooling of the fibers, and offering a longer lifetime to the fibers.

On the other hand, when the torsion rate is too high, the length of the fibers in the spiral is not enough to cool the fiber sufficiently and the upstream side is heated too much. Further, the density becomes higher, which provides not enough equal fuel passage. Since the latter is also to prevent descending of the temperature downward from the downstream to the upstream surface, which is a disadvantage. Therefor, the torsion rate is to be kept is the range according to the present invention.

Another aspect which was noticed, is that during combustion, the bundles of machined metal fibers having a torsion so to say "expand a little bit, providing even more an improved covering ratio, and a more equal flame distribution over the burner membrane surface.

It was further found that, compared to the textile fabric as described in WO97/01452, the present textile fabrics are obtainable to a lower cost, since the production of a textile fabric as subject of the invention requires less production steps and no additional raw material to be removed after weaving. Especially since at least 60% by weight of the textile fabric is provided by these bundles of machined metal fibers.

In the scope of the present invention, machined metal fibers are to be understood as metal fibers, obtained by machining, shaving or cutting the fibers off the end face of a thin metal foil coiled around a mandrel, as described in U.S. Pat. No. 4,930,199. This process provides a bundle of nearly parallel filaments with a predominantly quadrilateral cross-section, the equivalent cross-section of which is between 15 and 150 μm, depending on the thickness of the foil and the cutting speed of the shaving or cutting tool. Preferably, the equivalent diameter ranges between 15 μm and 65 μm, such as 22 μm, 35 μm, 40 μm or 60 μm. By equivalent diameter is meant here the diameter of the circle, which has the same surface area as the quadrilateral cross-section of the filament. The term filament here refers both to continuous filaments and staple fibers. Preferably however, the machined metal fibers have an average length of at least 10 cm. Average length of more than 15 cm or even more than 20 cm or 25 cm may be used.

In order to provide a burner membrane, the machined metal fibers in the bundles preferably are provided using a high temperature resistant stainless steel alloy. Most preferably, an alloy comprising a balance of Iron, further comprising chromium, aluminum and/or nickel, with 0.05 to 0.3% by weight of yttrium, cerium, lanthanum or titanium is used. Such alloys (such as known under the trade names FECRALLOY®, ALUCHROME® OR NICRALLOY®) are very resistant to high temperatures.

Depending on the fiber thickness, the linear weight of the bundle and the torsion rate, the bundle thickness may vary in the range of 1 to 5.5 mm. With linear weight of the bundle is meant the weight per length unit of the bundle. This is expressed in 'Tex', being g/km. With torsion rate is meant the number of turns the bundle make per length unit of the bundle, expressed in turns per meter (turns/m). The bundle thickness is measured by making a perpendicular cut of the bundle after it has been embedded in a polymer matrix, and measure the imaginary circle which encircles the cross-section of the bundle.

Such bundles are used to provide at least 60% by weight of the textile fabric. The other elements used to provide the textile fabric may be e.g. metal wires or very fine metal fiber yarns, or bundles of machined metal fibers as described in WO97/04152, having a linear weight being significantly smaller than the bundles machined metal fibers with a torsion rate according to the invention. Alternatively, yarns comprising ceramic fibers, such as AlO2- or SiO2-based fibers may be used, such as e.g. QUARTZEL® fiber yarns.

Alternatively, the textile fabric may consist of bundles of machined metal fibers, having a bundle voluminosity in the range of 1% to 15%, and a torsion rate in the range of 10 to 80 turns per meter.

With "bundle voluminosity" is meant the weight of a certain volume of the bundle, compared to the specific weight of the metal alloy out of which the metal fiber fleece are provided. A machined metal fibers bundle having a linear weight of WLb Tex (=g/km) and a bundle thickness of Db (mm) has a weight per volume of $4000*WLb/\pi*Db^2$ ($g/m^3$). The metal alloy out of which the machined metal fibers are provided has a certain specific weight being ρm ($g/m^3$). The bundle voluminosity is to be understood as $$100*4000*WLb/\pi*Db^2\rho m\ (\%).$$

In a similar way, the fabric voluminosity is to be understood a the weight per volume of the fabric, compared to the specific weight of the material out of which the fabric is provided. A fabric with a surface weight WSf ($g/m^2$) and a thickness Tf (mm) has a weight per fabric volume of 1000*WSf/Tf.

When the fabric is provided using machined metal fibers bundles for Ametal % of the fabric weight and Ax % (being 100-Ametal %) out of a material X, the specific density of the material out of which the fabric is made, is defined as ρmaterial=(Ametal %/100)*ρmetal+(Ax %/100)*ρx. The fabric voluminosity is to be understood as $$100*1000*WSf/Tf*\rho material.$$

The torsion rate is to be understood as the number of turns (or torsions) per linear meter of bundle of machined metal fibers. Torsion in both S- and Z-direction may be used. Preferably, adjacent bundles of machined metal fibers, in either warp or weft direction of the woven textile fabric, have opposite torsion direction, in order to avoid curling of the woven textile fabric.

Thickness of the woven textile fabric is to be measured as provided for in ISO5084. Surface weight of the woven textile fabric is to be measured as provided for in ISO3801.

The air permeability is measured using a pressure drop over the surface of the woven textile fabric of 200 Pa. An air permeability of the burner membrane of more than 500 l/dm$^2$/min may be obtained. Advantageously, woven textile fabric with an air permeability of more than 1500 l/dm$^2$/min or even more than 1760 l/dm$^2$/min may be provided.

Preferably, the textile fabric is a woven textile fabric, having machines metal fiber bundles in warp direction, weft direction or in both directions.

Possibly, but not necessarily, bundles used in warp direction have a larger linear weigh than bundles in weft direction.

Preferably the machined metal fibers bundles with a torsion rate according to the present invention are used to provide either the warp or the weft elements of the woven textile fabric, whereas the other elements provide the weft, respectively the warp elements. The numbers of warp and/or elements per length unit of fabric, and the weaving structure may be chosen according to the required woven textile fabric properties. Preferably a plain woven structure, possibly with multiple warp and/or weft, or a twill-woven structure is used.

Alternatively, the textile fabric is braided, preferably but not necessarily using only one type of machined metal fiber bundles.

The textile fabric can also be obtainable by knitting, either warp or weft knitting. The knitted textile fabric may be obtainable using a single-bed or double-bed knitting machine, either being a circular or flat-bed machine.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
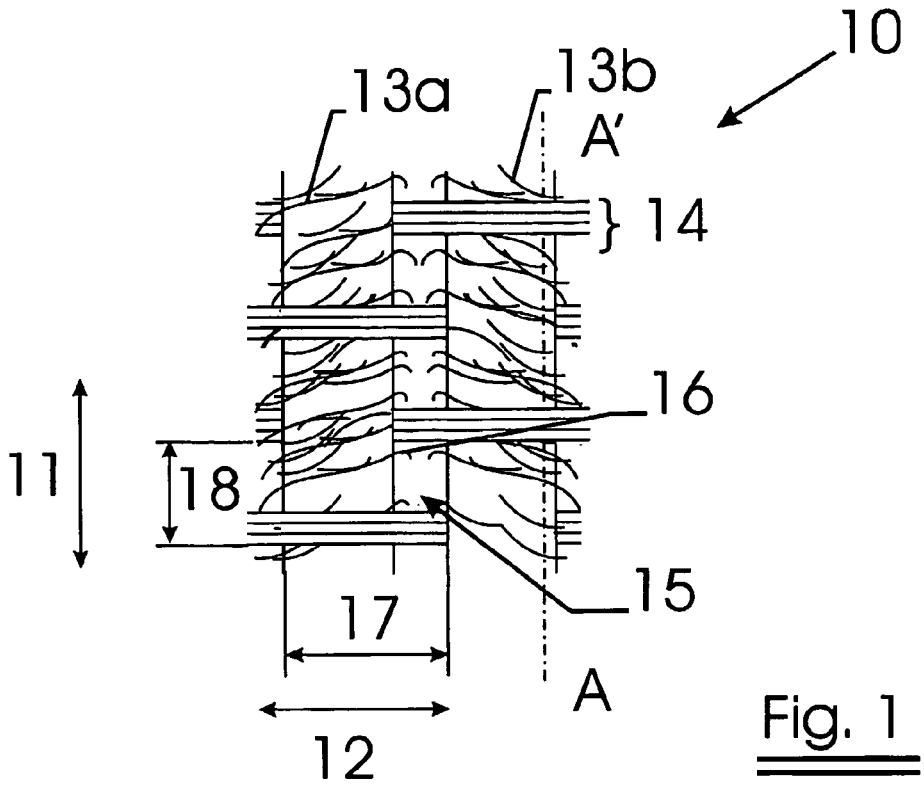
FIG. 1 is a woven textile fabric, to be used as a burner membrane as subject of the invention.

A textile fabric, to be used as a burner membrane as subject of the present invention is shown in FIG. 1. The woven textile fabric 10 has a warp direction 11 and a weft direction 12. In warp direction 11, bundles of machined metal fibers 13 are used as warp elements. In weft direction 12, weft elements 14 being preferably fine metal fiber yarns, possibly provided out of machined metal fibers without torsion are used to provide a woven textile fabric. As shown in the preferred embodiment in FIG. 1, weft element 14 may comprise more than one yarn. These groups of yarns may behave as a multiple weft. This means that several weft elements are incorporated into the woven textile fabric in the same, identical way. Between two warp elements and two weft elements, an open zone 15 is created, which is partially covered with machined metal fibers 16, extending out of the bundle of machined metal fibers at one side of the fiber.

Alternatively, weft elements comprise only one yarn, possibly this weft element may be a bundle of machined metal fibers with a torsion rate as in the scope of the present invention.

A preferred embodiment is provided using a bundle of machined metal fibers with linear weight of 3000 tex, and having a torsion rate of 36 turns/m. Adjacent bundles 13*a* and 13*b* have an opposite direction of torsion. The bundles, used as warp elements, having a bundle voluminousity of 5.3%

A woven textile fabric comprising such bundles of machined metal fibers is provided using the bundles as warp elements of a plain-woven fabric. Weft elements preferably comprise four yarns of machined metal fibers, having no torsion but being provided according to the process as described in WO97/04152, having a linear weight of 357 tex each. A warp element is provided each 3.33 mm in weft direction of the fabric, indicated with distance 17 in FIG. 1. A weft element is provided each 6 mm in warp direction of the fabric, indicated with distance 18 in FIG. 1. the bundles of machined metal fibers, in this embodiment being the warp elements, provide 78% by weight of the woven textile fabric.

This preferred embodiment of a woven textile fabric, use as a burner membrane, has a surface weight of 1.2 kg/m$^2$, a thickness of 2.5 mm, and a fabric voluminousity of 5.71%. An air permeability of 1760 l/dm$^2$/min using 200 Pa pressure was obtained. A covering ratio of 82.9% was obtained.

Machined metal fibers used to provide the bundles of machined metal fibers are provided using a high temperature resistant stainless steel. Preferably an alloy comprising a balance of Iron, further comprising chromium and aluminum, with 0.05 to 0.3% by weight of yttrium is used.

Figure 2:
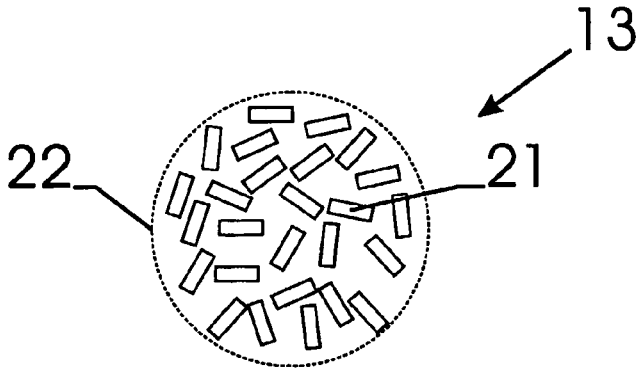
FIG. 2 is a cross-section of a bundle of machined metal fibers.

As indicated in FIG. 2, being a perpendicular cross-section of a bundle of machined metal fibers 13, the machined metal fibers 21 have a quadrilateral section. The equivalent diameter is preferably in the range of 15 μm to 65 μm, such as 40 μm for the preferred embodiment as shown in FIG. 1. In order to measure the bundle thickness, an smallest possible imaginary circle 22 is defined, which encircles the perpendicular cross-section of the bundle of machined metal fibers.

An alternative embodiment is provided using four bundles of machined metal fibers with a linear weight of 1000 tex and a torsion rate in the range of 30 to 50 turns/m as weft elements 14, whereas all other elements remains unchanged as compared to the embodiment of FIG. 1. Preferably the adjacent bundles in weft direction have an opposite direction of torsion. It is clear that this embodiment, the bundles of machined metal fibers provide 100% weight of the woven textile fabric.

Figure 3:
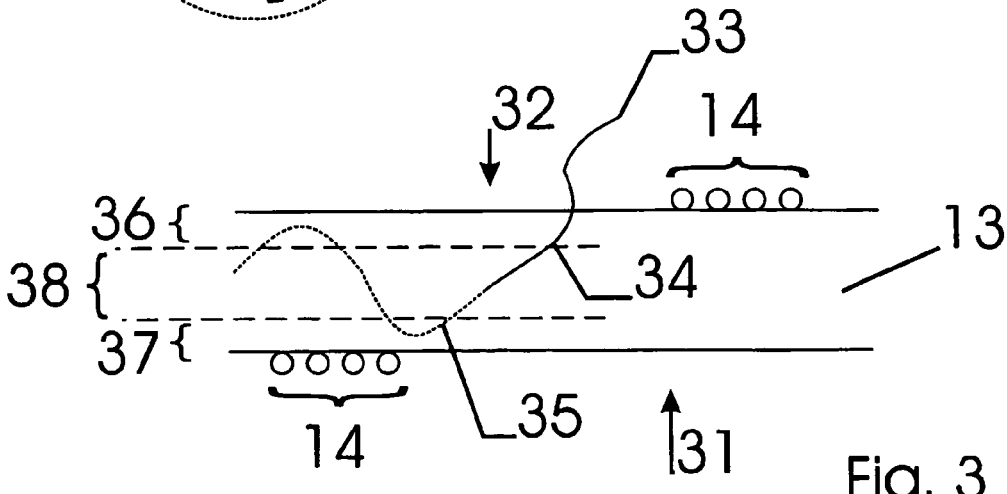
FIG. 3 is a cross-section according to plane AA' of the woven textile fabric of FIG. 1.

The woven textile fabric, as shown in FIG. 1, is to be used as a burner membrane according to the present invention. One side of the woven textile fabric, facing the incoming fuel, is the upstream side. The fuel cools this side of the fabric. in the cross-section in FIG. 3 (being a cross-section of the fabric as shown in FIG. 1 according to the plane AA') upstream side is indicated with arrow 31. The downstream side 32 of the fabric is the side on which the fuel is combusted a machined metal fiber 33 is partially extending the machined metal fibers bundle 13 (extending part of the fiber indicated in FIG. 3 as 34), and partially incorporated inside the bundle (part indicated in FIG. 3 as 35). Therefor, the fiber does not migrate out of the bundle that easy (due to the part 35), but on the other hand, the extending part 34 may cover to some extend the open zones 15, so providing a higher covering ratio to the fabric.

Further, the fiber 33 is repetitively present in the hot zone 36 of the burner membrane, and in the cold zone 37 of this burner membrane. Therefor, the thermal energy, provided by the combustion of the fuel, may be spread over the whole fiber length (being preferably more than 10 cm). The fiber is cooled in the cold zone 37 and the middle zone 38 of the textile fabric. The burner membrane, used as a radiating burner membrane, has the tendency to obtain a higher temperature at its downstream side, whereas the fibers are not consumed more rapidly due to thermal degradation, nor the burner membrane suffers from flash-backs, thanks to the good thermal insulation and balanced thermal conduction and cooling of the fibers.

The invention claimed is:

1. A burner membrane comprising a textile fabric, said textile fabric comprising at least 60% by weight of machined metal fiber bundles, wherein a machined metal fiber bundle has a bundle voluminousity in the range of 1 to 15% and a machined metal fiber bundle has a torsion rate in the range of 10 to 80 turns/m.

2. A burner membrane as in claim 1, wherein said textile fabric has a fabric voluminousity in the range of 1 to 15%.

3. A burner membrane as in claim 1, wherein said machined metal fiber bundle has a linear weight in the range of 500 to 10000 tex.

4. A burner membrane as in claim 1, wherein said textile fabric has a covering ratio of more than 70%.

5. A burner membrane as in claim 1, wherein said textile fabric has an air permeability of more than 1000 $l/dm^2/min$.

6. A burner membrane as in claim 1, wherein said textile fabric has a thickness in the range of 1 to 5 mm.

7. A burner membrane as in claim 1, wherein said textile fabric has a surface weight in the range of 0.2 to 4 $kg/m^2$.

8. A burner membrane as in claim 1, wherein said machined metal fiber bundles are stainless steel fibers.

9. A burner membrane as in claim 1, wherein said machined metal fiber bundles are provided using an alloy comprising chromium, aluminum and/or nickel, with 0.05 to 0.3% by weight of yttrium, cerium, lanthanum or titanium, and further comprising a balance of iron.

10. A burner membrane as in claim 1, wherein said machined metal fibers have an equivalent diameter of 15 to 150 μm.

11. A burner membrane as in claim 1, wherein said machined metal fibers have an average length of more than 10 cm.

12. A burner membrane as in claim 1, wherein said textile fabric is a woven fabric.

13. A burner membrane as in claim 1, wherein said textile fabric is a braided fabric.

14. A burner membrane as in claim 1, wherein said textile fabric is a knitted fabric.

15. A burner membrane as in claim 14, wherein said knitted fabric is a weft knitted fabric.

16. A burner membrane as in claim 14, wherein said knitted fabric is a warp knitted fabric.

* * * * *